US007393286B1

(12) United States Patent
Renegar

(10) Patent No.: US 7,393,286 B1
(45) Date of Patent: Jul. 1, 2008

(54) CORRUGATED SOLE FOR A UTILITY WEDGE GOLF CLUB

(76) Inventor: Robert Milton Renegar, 304 Black Bear Trail, Murfreesboro, TN (US) 37127-8314

( * ) Notice: Subject to any disclaimer, the term of this patent is extended or adjusted under 35 U.S.C. 154(b) by 246 days.

(21) Appl. No.: 11/148,625

(22) Filed: Jun. 9, 2005

(51) Int. Cl.
*A63B 53/04* (2006.01)

(52) U.S. Cl. ..... 473/328; 473/350

(58) Field of Classification Search ..... 473/324–350
See application file for complete search history.

(56) References Cited

U.S. PATENT DOCUMENTS

| | | | | |
|---|---|---|---|---|
| 1,541,126 | A | 6/1925 | Dunn | |
| 1,617,090 | A | 2/1927 | Worthington | |
| 3,079,157 | A | 2/1963 | Turner | |
| 3,810,631 | A | 5/1974 | Braly | |
| 3,897,065 | A | 7/1975 | Solheim | |
| 4,854,580 | A | 8/1989 | Kobayashi | |
| 5,301,944 | A | 4/1994 | Koehler | |
| 5,603,668 | A * | 2/1997 | Antonious | 473/328 |
| D411,274 | S | 6/1999 | Renegar | |
| 6,290,607 | B1 * | 9/2001 | Gilbert et al. | 473/291 |

FOREIGN PATENT DOCUMENTS

| | | | |
|---|---|---|---|
| JP | 2000229137 | A * | 8/2000 |

* cited by examiner

*Primary Examiner*—Alvin A Hunter
(74) *Attorney, Agent, or Firm*—PRO SE

(57) ABSTRACT

An improved sole contour for a wedge golf club head is provided comprised of one or more V-shaped cuts (16) into the sole of said club head creating multiple bounce sole contours (26) for sand play, while eliminating the dangerously raised leading edge (28) that limits the utility for play of conventional sand wedge golf clubs. Said V-shaped cuts (16) are made substantially parallel to the grooves of the club face (12), and the more forward surface (24) created by any V-shaped cut (16) is substantially parallel to the impact surface (12) of the club head, while the rearward surface (26) is employed to provide whatever bounce surfaces (14), shapes, and angles (b) that are desired for play.

7 Claims, 3 Drawing Sheets

CORRUGATED SOLE FOR A UTILITY WEDGE GOLF CLUB

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to golf clubs, specifically an improved sole contour for wedge golf clubs providing improved utility for all short game play in the game of golf.

2. Prior Art

Gene Sarazen invented the bounce sole contour for the modern sand wedge club in the early 1930's—specifically for sand play (See FIG. 1). That same sole contour remains the standard for wedge clubs 70 years later following the turn of the millennium. The great problem with the Sarazen bounce sole contour is that it was designed exclusively for sand play—whereas, the modern game of golf has evolved into a far more demanding game with regard to short game shot-making situations. Golf equipment in general has changed greatly, and the golf courses where the modern game is played are more difficult—wedge clubs now need greater versatility.

The singular purpose for Sarazen's widely copied bounce sole contour for sand wedges is for playing sand bunker explosion shots—certainly less than 20% of all short game play. For ALL other short game situations (the great majority the modern golf player encounters) this bounce sole contour is problematic.

This same Sarazen-inspired bounce sole that is so helpful for sand shots creates a dangerously raised leading edge for the bottom of the club face (approximately 6 mm.) above the playing surface. This raised leading edge increases the difficulty associated with playing all other short game shots (besides bunker explosion shots), increases the skill and precision required for executing these shots, and greatly increases the risk of a poor outcome with a less than perfect shot attempt. This also creates limitations with regard to weight distribution in a sand wedge club head design.

This raised leading edge problem for sand wedges has not been ignored by the better golf equipment designers over the years. Attempts at lowering the leading edge for improved short game play have been many and varied. Some designers have tried adding a convex or cambered shape modification (extending face to back) to a basic Sarazen bounce sole. This had the effect of lowering the leading edge, but this also reduced the effective bounce angle for the rearward portion of the bounce sole. Other designers have simply reduced the width of the bounce sole to lower the leading edge—also compromising the sand play effectiveness of that golf club. Many of these designs are present in the current state of the art.

There have also been several reduced bounce angle cambered wide sole club head designs to appear in golf during the last 20 years—specifically intended to help the golfer that lacks the skill or knowledge of technique required to play bunker explosion shots. Reduced bounce angle cambered wide sole designs (FIG. 3) play acceptably from bunkers for explosion shots and play square-faced shots well enough, but they lack the essential versatility of opening the club face to add loft when needed to increase trajectory or ball spin rates. Opening the club face on these wide sole club designs will raise the leading edge to heights completely unplayable, thereby limiting these designs greatly in their versatility—the versatility needed by players of all skill levels for the broader range of shot-making situations encountered in the modern game of golf.

Koehler's dual bounce sole (U.S. Pat. No. 5,301,944 issued April 1994) lowered the leading edge with his two distinctly different bounce surfaces, but the bounce angle for his larger rearward surface was at the same time significantly decreased (see FIG. 4)—thereby reducing the playing effectiveness of this design for bunker explosion shots—Koehler just compromised the golf club's playing effectiveness for bunker explosions to obtain the needed utility of a lowered leading edge.

Braly's concave sole design (U.S. Pat. No. 3,810,631 issued May 1974) was another lowered leading edge improvement for a sand wedge. In this design, the inventor introduced an area of concavity to the sole of the golf club for providing bounce when needed for bunker play (see FIG. 5). The great problem with the Braly sole was two-fold. First, this sole design produced an excessively wide sole and thick club head, which was completely unplayable for open-faced playing situations. Secondly, with the effective bounce contour being derived from the concavity extending from the forward part of the sole toward the rear, the effective bounce angle was constantly changing. This design concavity provided an ineffective negative bounce angle in its most forward areas and gradually transitioned through a point of zero bounce to an area of maximum bounce angle at the most rearward edge—but it still provided only a minimal bounce angle even at that most rearward point. The effectiveness of this design for sand play was found in the increased surface area of the bounce surface provided instead of the steepness (or correctness) of the bounce angles.

Both Koehler and Braly offered the lowered leading edge improvement that was needed, but they compromised either bounce effectiveness for utility (Koehler), or they compromised utility for bounce effectiveness (Braly)—neither provided both.

Still other bounce sole designs from the prior art lacked the essential understanding that bunker explosion shots only comprised a small portion of the total demands of the short game, and they did little to lower the leading edge—unless they too reduced the bounce angles.

OBJECTS AND ADVANTAGES

It is the purpose of the present invention to provide a new and improved sole design for golf short game wedge play that eliminates the raised leading edge problems arising from the bounce sole contour for the great majority of all short game playing situations, while simultaneously preserving the well-established playing advantages of the bounce sole contour for sand play—thereby providing the golfer with a wedge club of much greater utility.

The playing advantages of the present invention include at least all of the following improvements versus the prior art:

A. The leading edge of the club face is significantly lowered (to approximately 50% or less than the height of an equivalent Sarazen bounce sole) for improved play on square-faced shots played from tight lies, shots from downhill lies, and buried lie shots in sand bunkers.

B. The risks associated with "sculled" shots are greatly reduced by lowering this leading edge (where the leading edge of the club head impacts the ball instead of the intended area of the club face, resulting in a catastrophic low trajectory extra distance shot result).

C. The center of gravity in any club head of this improved design is also moved upward and rearward providing:
   a. increased ball spin rates,
   b. a higher moment of inertia for improved stability on off-center hits,
   c. improved control of trajectory management situations, and
   d. improved energy transfer on center hits and off-center hits for greater distance.

D. Increased surface area and steeper bounce angles on the sole contour are provided for better open-faced sand play explosion shots without compromising play in other short game situations.

E. Proper club head alignment (naturally squared to the target line) is achieved when placing the club head behind the golf ball at normal address before the shot is attempted.

F. Appropriate bounce for playing sand explosion shots is provided for any type or texture of sand encountered by the player—ranging from firm wet sand to soft powdery sand.

G. The weight distribution provided by the different shape of the sole contour improves consistency for direction and distance on off-center hits (versus the Sarazen sole's excessive energy transfer that occurs on low hits—as proven by robot testing).

H. An open-faced club head orientation is achievable for play (when additional loft and spin are desired) that maintains this important lowered leading edge in tight lie playing situations.

Other objects and advantages will become apparent from the specification and drawings that follow.

SUMMARY

The present invention provides a solution to the longstanding problems associated with attempting to play all short game shots in golf with SAND wedge golf clubs that have been specifically designed for sand bunker explosion shots. The problematic raised leading edge characteristic of the Sarazen-inspired prior art is eliminated without compromising bounce surface performance for sand play. This most significant improvement is accomplished by adding to the sole contour of a wedge club one or more V-shaped cuts longitudinally from heel to toe that create several smaller bounce surfaces—thereby eliminating the problems arising from a single large bounce surface and/or a steep bounce angle that together will raise the leading edge of a prior art golf club. Many different embodiments of this improvement are possible.

DRAWINGS

Figures

In the drawings, closely related figures have the same number but different alphabetical suffixes.

LIST OF REFERENCE NUMERALS

Figure 1A:
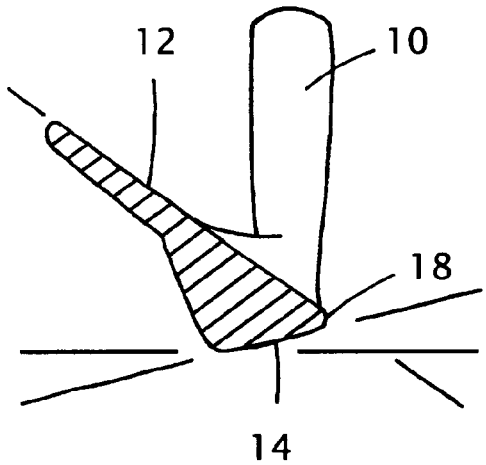
FIGS. 1A and 1B show face center cross sectional views of a golf club head employing the widely copied Sarazen-inspired bounce sole from the prior art with parts and measures identified by reference letters and numerals.

10 hosel or neck (club head attachment to shaft)
12 club face or impact surface of the club head
14 sole contour bounce surface
16 V-shaped sole cut of the present invention
18 leading edge of the club head
20 sole width (most forward to most rearward vertical projection)
22 club head thickness (perpendicular distance from impact surface to most rearward projection of the sole)
24 forward surface of V-shaped sole cut
26 rearward trailing bounce surface of V-shaped sole cut
28 leading edge height above playing surface
a loft angle
b bounce surface angle
c overall "gauge measured" bounce angle for the entire club head

DETAILED DESCRIPTION

Preferred Embodiment

Figure 2:
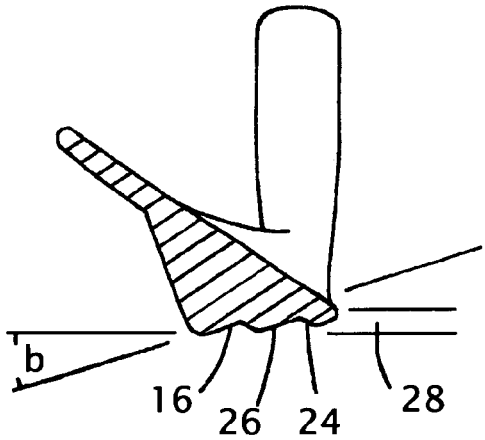
FIG. 2 shows a face center cross sectional view of a golf club head employing the corrugated sole present invention, illustrating the multiple bounce surfaces and the lowered leading edge created by the "V-shaped" sole cuts.

A preferred embodiment of the present invention is illustrated in FIG. 2 of the drawings. This drawing is a face center cross-sectional view of a generally metallic investment cast or forged golf club head employing this golf club improvement. This view shows the lowered leading edge and multiple bounce surfaces created by the V-shaped cuts in the sole contour. The preferred embodiment may include anywhere from one to a plurality of V-shaped sole cuts. The number of cuts is not very important as long there is at least one cut and not so many cuts that the effectiveness of the bounce surfaces is lost. The V-shaped cuts of the preferred embodiment are made longitudinally in the sole of the golf club contour extending approximately from heel to toe of the sole—approximately parallel to the alignment of the grooves on the impact face surface. The angle created by the surfaces of the V-shaped cut will be an obtuse angle—normally in the range of 110 degrees to 155 degrees.

The sole contour surface extending down from the leading edge of the golf club rearward to the first V-shaped cut will create the most forward bounce surface of the present invention (and is very similar to a prior art bounce sole). This is usually a slightly convex surface due to the "tear-drop" shaping of the club head as viewed from overhead in the playing position. The bounce angle of this most forward bounce surface should not exceed about 25 degrees and will most commonly be in the range of 12 to 16 degrees. The most forward edge of any corrugated sole V-shaped cut would be located no more than about 8 mm behind the leading edge, also making the sole width for this most forward bounce surface no greater than 8 mm.

Each V-shaped sole cut thereafter will create an additional sole contour bounce surface. The total number of bounce surfaces on any sole of the present invention will be equal to the number of V-shaped sole cuts plus one to account for the leading edge bounce surface. Therefore, a sole contour with two cuts will have a total of three resultant bounce surfaces, et cetera.

The overall "bounce gauge measurement" of the bounce angle for a golf club head of the present invention will generally be measured in the range of 4 degrees positive bounce (see FIGS. 2, 6A, 6B, 7A, 7B). This approximate angle is preferred, because it will yield a naturally squared club head alignment when the golf club is placed on the ground in a normal address position, and because it will yield the desired lowered leading edge. Obviously, this angle may be more or less than the 4 degrees preferred. The bounce angles of the individual surfaces provided by the leading edge surface and the more rearward bounce surfaces derived from the V-shaped bounce cuts may be at any bounce angles desired. Generally, bounce angles in the range of 0 to 25 degrees will be most effective for bunker explosion shots—12 to 16 degrees seems to be the range of most widely manufactured bounce angles.

The steepness of the bounce angle and the width of the bounce surface extending rearward from the leading edge will dictate in part how high the leading edge will be above the playing surface for the present invention. The overall "gauge measured" bounce angle will make a secondary determination of how high the leading edge will ultimately be.

A golf wedge sole contour made as described above by the present invention will play square-faced shots with a leading edge lowered very close to the playing surface, but opening the club face for a bunker explosion shot will expose adequate bounce for successful execution of that shot.

Figure 1B:
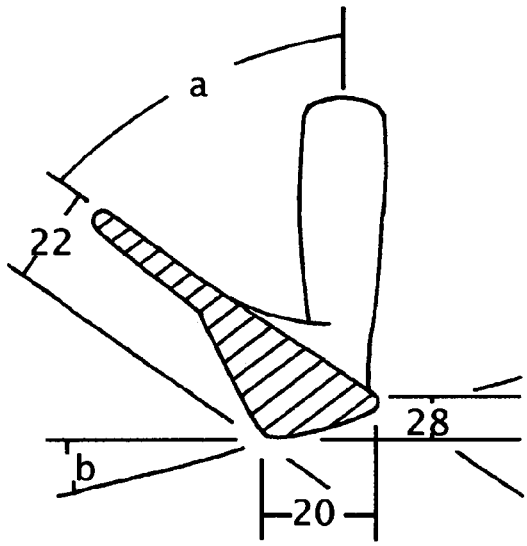

Cross-sectional "toe" views of a conventional Sarazen type bounce sole contour (FIG. 1) and the present invention corrugated sole contour (FIG. 2) are illustrated. The bounce angle as illustrated in FIG. 1B is the angle formed between the ground and a line tangent to the center of the sole surface contour. Note the height of the leading edge above the playing surface in the FIG. 1B Sarazen bounce sole design in a normal address orientation compared to the height of the leading edge in the improvement of the present invention as shown in FIG. 2.

Bounce angles in a normal set of irons clubs will generally range from 2 degrees in the long irons to four degrees in the pitching wedge. Bounce surfaces in irons sets have the singular purpose of optimizing natural club head alignment at address—excessively positive bounce angles in irons and wedges will close the club face at address, and reduced or negative bounce angles will have the opposite effect of opening the club face at address.

Wedges beyond the pitching wedge from the prior art will generally have bounce sole contours ranging from 6 degrees to 16 degrees, depending upon the manufacturer's offering and the intended usage for that particular club. These wedges will also be identified as "pitching" wedges, "gap" wedges, "sand" wedges, and "lob" wedges—with loft angles for each of these respective clubs gradually increasing from about 45 degrees to 60 degrees for common lob wedges or more.

The "bounce" effectiveness of a given bounce sole contour is a function of both the steepness of the bounce angle and the total surface area of that bounce contour. Generally, steeper bounce angles and larger bounce surface areas will enable greater ease of sand play for bunker explosion shots, but both steeper angles and larger surface areas will generally tend to exacerbate the problems associated with a raised leading edge and compromised utility for playing situations other than sand shots.

Figure 3:
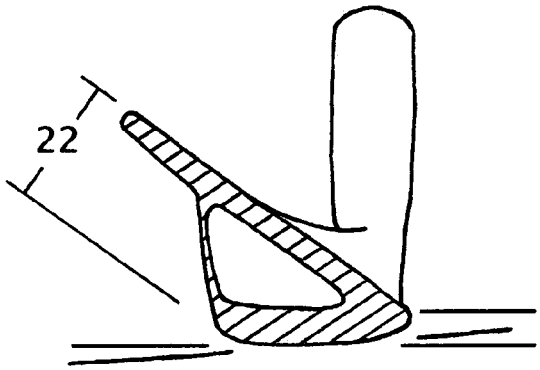
FIG. 3 shows a face center cross sectional view of a cambered wide sole club head with reduced bounce angle (normally a hollow construction).
Figure 4:
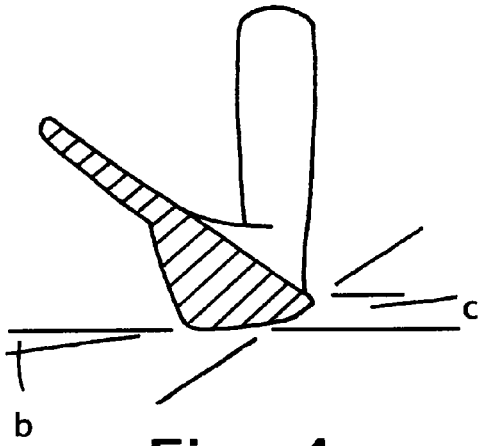
FIG. 4 shows a face center cross sectional view of a club head with the Koehler "dual bounce" sole improvement illustrating both bounce angles and the lowered leading edge.
Figure 5:
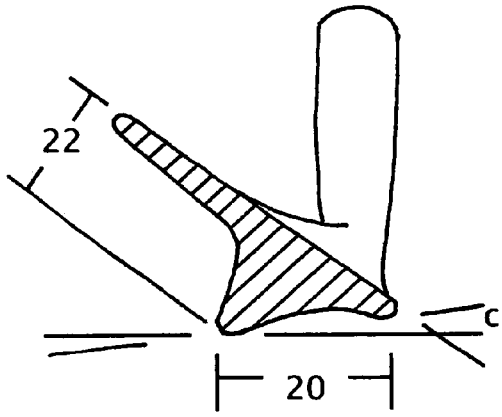
FIG. 5 shows a face center cross sectional view of a golf club head employing the Braly concave sole improvement with its lowered leading edge.

Head thickness 22, as measured along a line perpendicular to the plane of the impact surface from this impact surface to the most rearward projection of the sole contour, will determine in large part the height of the wedge's leading edge in an open-faced playing situation. Note the excessive head "thickness" of the Braly "concave sole" (FIG. 5) and the reduced bounce angle wide sole prior art (FIG. 3). Reducing the "thickness" of a club head will reduce the height of the leading edge when the club is played in an open-faced situation. Moving the location of this maximum head thickness to a higher and more rearward location relative to the leading edge (as in the present invention) is also beneficial for keeping the leading edge lowered when the club face is opened. Being able to utilize a wedge club in open-faced situations to add loft for higher trajectory and increased ball spin rates is essential for players at every skill level. This requirement for playing "open-faced" shots is unique to wedge clubs in golf.

OPERATION OF THE PRESENT INVENTION

FIG. 2 shows a cross-sectional "toe" view of the corrugated sole contour from the present invention. This view of the corrugated sole contour begins to show its many obvious advantages. An overall bounce measurement is provided that permits a naturally square club face at set-up (probably about 4 degrees bounce) and the leading edge is lowered by approximately 3 mm. Multiple smaller bounce surfaces are provided—equaling or exceeding the total bounce surface area of any conventional Sarazen sole design. But the bounce angles of the present invention V-shaped cuts can be steeper (or reduced) without affecting the height of the leading edge 28 above the playing surface upon which the ball is resting. Different bounce angles in a single "corrugated" sole contour are possible. Bounce surfaces that are not limited to a single planar surface are possible—enabling complex curved surfaces if so desired. Concave and convex bounce surfaces are possible. The corrugated sole therefore may be embodied by multiple bounce surfaces—of various sizes, bounce angles, and different shapes.

A higher and more rearward center of gravity location is obviously provided. The maximum "thickness" of this sole contour is also moved higher and more rearward than other designs—further providing a lowered leading edge during open-faced playing situations. This corrugated sole contour may be utilized on a wedge type golf club of any loft—thereby greatly improving the short game utility of any such club. Complete "sets" of wedges employing the present invention are possible that all embody the corrugated sole for maximum utility.

Normal greenside bunker explosion shots are executed using the Sarazen sole design by rotating the clubface clockwise (for a right-handed player), thereby aiming the club face to the right of the intended target line. The player then aligns his body (and swing plane) left of the target line to offset the right aligned club face. Opening the club face has the effect of adding loft to the club face (creating a higher, softer shot with increased ball spin rates) and further provides the very important effect of adding bounce to the sole contour—increasing the bunker explosion efficiency.

The corrugated sole wedge contour of the present invention operates in just the same manner as the prior art for the bunker explosion shot. When the club face is opened, loft is added; but this also creates the only situation that exposes the multiple bounce surfaces of the corrugated sole. Hence, bounce surfaces are provided only when they are needed. For all other short game playing situations, the bounce sole is no longer a problem.

Having the plane of the more forward surface of the V-shaped corrugated cuts essentially parallel to the plane of the club face most importantly maximizes the amount of bounce surface area provided by the rearward surfaces of the corrugation "cuts" when the club head is turned into an opened orientation for a bunker explosion shot.

Robot Test

A mechanical robot golfer was employed to test the wedge clubs from the two current golf industry sales leaders (both Sarazen-inspired bounce sole designs) against the present invention to determine whether other playing advantages existed for the improved corrugated sole design beyond the previously described playing utility of the present invention's improved sole contour. The cross-sectional view of the Sarazen bounce sole design shown in FIG. 1 illustrates by simple inspection that a large concentration of mass is present below the leading edge of the impact surface and in a "forward" position relative to the normal impact point. The present invention provides for much of this same mass to be moved upward and rearward—thereby moving the center of gravity of the corrugated sole design upward and rearward into a more favorable location. Distribution of mass in a golf head design is known to produce wide variations in performance characteristics—particularly with regard to distance and direction on "off-center" hits.

Initially, all three test subject wedges were carefully measured in a golf club design laboratory to make certain that all physical design variables measured equally from test club to test club. Shaft length and club head loft in particular are both variables that are known to affect distance for a golf club. Both were held constant for this test.

The robot employed for this test was from an independent laboratory—highly regarded for this testing expertise within the golf industry. This robot utilized a computer controlled D.C. servomotor to reproduce a golf swing. This same robot is the current "standard" for the golf industry—used by almost all major golf equipment manufacturers for their robot testing.

It is common practice in the golf industry to "map the face" of a golf club robotically to determine its performance goodness. That outcome is then illustrated graphically with a range and azimuth-based graphing of a "shot dispersion pattern" for analytical purposes. This "face mapping" includes hitting shots at the designed face center of the club head and then in four characteristic off-center impact locations—toward the heel, toe, high, and low.

Launch conditions during this testing were very carefully monitored, controlled, and replicated—including taking distance and direction measurements to the nearest foot and noting real time weather data for every ball hit. Balls were all identical and new. Statistically valid sample sizes for all test shot locations were completed, hitting balls at the face center for play and then hitting balls in these four most common areas of off-center hits. These five testing locations on each clubface were reproduced meticulously utilizing a template and precision measuring instruments for locating every shot.

TABLE Z

| TEST SUBJECT | CENTER | HIGH | LOW | HEEL | TOE |
|---|---|---|---|---|---|
| Club C | 79.0/−1.0 | 75.2/−1.4 | 83.7/+0.6 | 79.0/−2.0 | 76.2/+0.7 |
| Club T | 78.2/+1.7 | 77.2/+1.2 | 84.7/+3.0 | 76.9/+1.8 | 76.4/+3.0 |
| Present Invention | 87.7/−1.0 | 84.4/−2.2 | 86.9/+0.0 | 85.2/−3.0 | 86.9/+1.0 |

Notes:
All test measurements are expressed in yards. Indicated values are read as "distance/direction". Positive and negative directional values indicate left (negative) and right (positive) of the intended target line. Indicated values represent the averages of statistically valid samples of robot hits for each face location test.

Analysis of Robot Test Results—Table Z

Table Z charts the results from that robot test. By simple inspection, it is clear that both sand wedges from the current state of the art that employ the Sarazen-inspired bounce sole contour performed very similarly. Their similar shapes and weight distributions would create that expectation. The present invention performed very differently, however. While both current industry sales leaders performed acceptably in most situations, balls hit below face center (low shots) produced great inconsistency in distance compared to impact on other face positions. And worse yet, this "low" error is the most common error for most players—commonly called a "thin" hit.

Further, in great contrast to the two sales leaders utilizing the Sarazen sole design, the present invention performed with great superiority. It produced shot results that traveled about 10% farther (with identical launch input and control) on center hits, and it created a shot dispersion pattern that was approximately ⅓ the area of the two sales leaders—therefore providing three times the accuracy on off-center hits. Variation in distance for the corrugated sole design club (from longest observed results to shortest) was approximately one-third (just over 3 yards) that of the two industry sales leaders (nearly 9 yards). This type of measured performance superiority has great potential for impact to the play of any golfer, because almost all golfers regularly make face location errors at impact. The present invention provides for a more consistent result, nearer to an intended target, regardless of the impact face location error introduced by the player.

Description and Operation of Alternative Embodiments

It should be clear from the explanations above that many different embodiments of the present invention are possible—where one or more V-shaped cuts are inscribed into the sole of a wedge golf club, creating bounce for sand play while retaining the lowered leading edge so essential for all other short game play. Any other alternative embodiments would operate similarly to the preferred embodiment, but they might look very different and still be very clearly derived from the claims with this application.

Figure 6A:
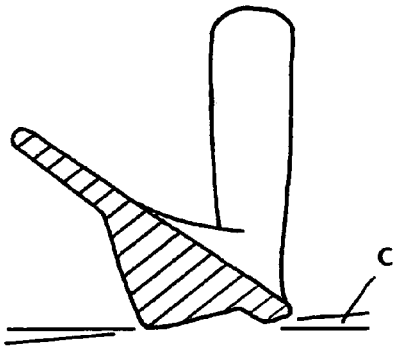
FIGS. 6A and 6B show face center cross sectional views of other embodiments of the corrugated sole with differing numbers of sole contour cuts.
Figure 6B:
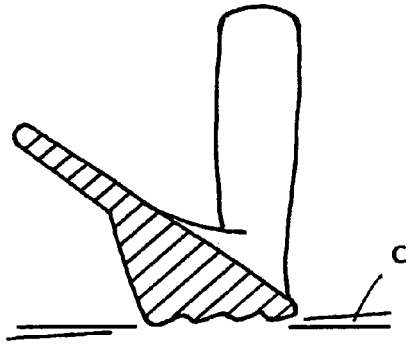
Figure 7A:
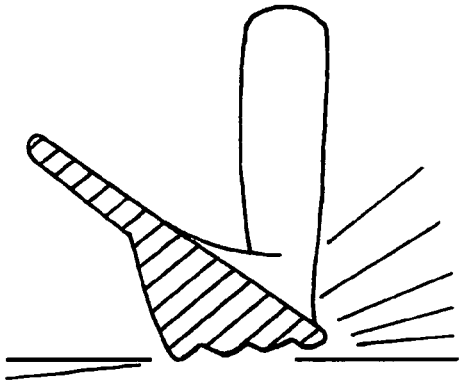
FIG. 7A shows a face center cross sectional view of a corrugated sole with increasing bounce angles from front to back.
Figure 7B:
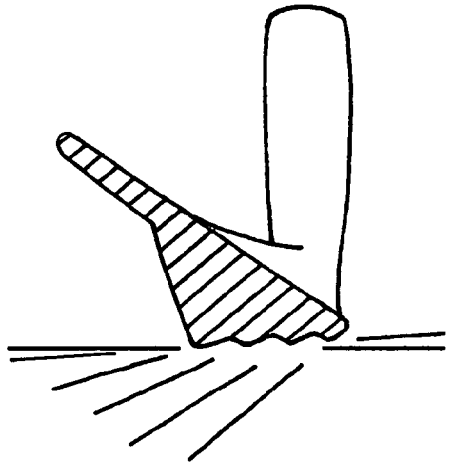
FIG. 7B shows a face center cross sectional view of a corrugated sole with decreasing bounce angles from front to back.
Figure 8A:
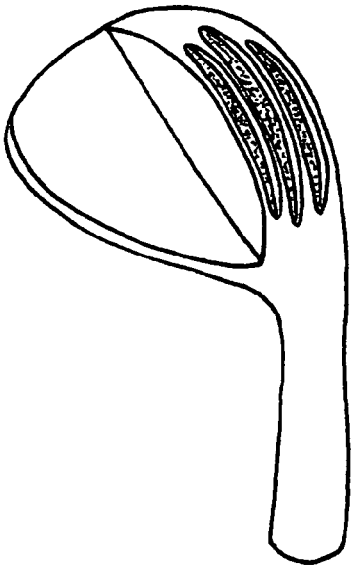
FIG. 8A shows a perspective view of a golf club head employing the corrugated sole with the V-shaped cuts that are curved from heel to toe.
Figure 8B:
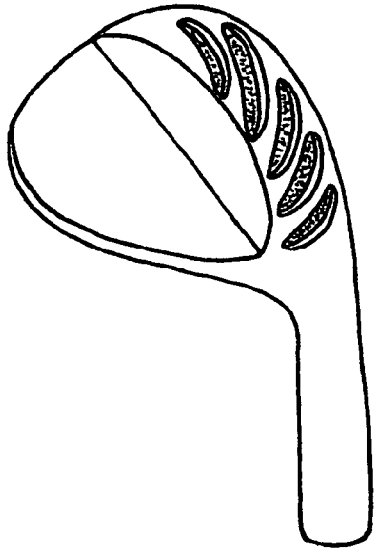
FIG. 8B shows a perspective view of a golf club head employing the corrugated sole with V-shaped cuts that are curved and not aligned parallel with the face grooves.

FIG. 2 shows a face center cross-sectional view of one preferred embodiment with two V-shaped cuts in the sole of that golf club. Similarly, FIGS. 6A and 6B show alternative embodiments with differing numbers of cuts in the sole. FIGS. 7A and 7B show alternative embodiments with the steepness of the bounce angles progressively changing from one V-shaped sole cut to another. FIGS. 8A and 8B show perspective views of yet other possible embodiments where the shape and orientation of the cuts is changed. All of these embodiments will operate in nearly identical manner. Clearly the present invention is quite broad in its potential for application to wedge golf clubs with differing shapes and looks.

CONCLUSION, RAMIFICATIONS, AND SCOPE OF THE INVENTION

Accordingly, the reader will see that the present invention provides an improved sole contour for ALL short game play in the game of golf without compromising the proven effectiveness of the bounce sole contour for sand bunker explosion shots. Golfers of all skill levels will benefit greatly from the corrugated sole's increased playing utility and obtain lowered scores in their games of golf. Further, this improved shape provides a re-distribution of mass in the wedge club head that enhances consistency and provides a much larger margin of error on off-center hits—thereby leaving the golf ball closer to its intended target in spite of any off-center hit—resulting in shorter putts and surely lowered scores.

While the above description contains many specificities, these should not be construed as limitations in the scope of the invention, but rather as examples of some presently preferred embodiments thereof. Many other ramifications and variations are possible within the teachings of the invention. For example the corrugated sole might be embodied by several parallel cuts in the sole, non-parallel cuts in the sole, curved cuts, concave and convex surfaces, multiple bounce surfaces with changing bounce angles, cuts not aligned with the grooves, and cuts manufactured utilizing different materials or manufacturing processes—or combinations of any of these variations. This improved sole is also not limited to golf club heads of any particular shape or design type. Thus the scope of the invention should be determined by the appended claims and their legal equivalents, and surely not limited by the examples given.

I claim:

1. A wedge-type club head for use on a playing surface having an impact surface, a toe, a heel, and a sole, the club head comprising:

a leading edge of said impact surface being a distance above the playing surface of approximately 4 mm or less; and the sole comprising:

a sole contour having at least one V-shaped cut, wherein said at least one V-shaped cut extends in a heel to toe direction and said at least one V-shaped cut comprises multiple surfaces wherein one of said multiple surfaces is a forward surface substantially parallel to the impact surface; said multiple surfaces of the at least one V-shaped cut forms an obtuse angle at an apex being 115 to 145 degrees, said at least one V-shaped cut creates bounce surfaces having bounce angles, said at least one V-shaped cut comprises a rearward bounce surface, wherein the rearward bounce surface is inclined forward above a playing surface with a positive bounce angle up to 25 degrees.

2. The wedge-type club head according to claim 1, wherein a rear surface of the sole bulges convexly rearward between the heel and toe.

3. The wedge-type club head according to claim 1, wherein the bounce surfaces are not flat surfaces.

4. The wedge-type club head according to claim 1, wherein said bounce angles vary between each other.

5. The wedge-type club head according to claim 1, wherein said at least one V-shaped cut does not provide a sharp angle at the apex.

6. The wedge-type club head according to claim 1, wherein said bounce surfaces are complex curves.

7. The wedge-type club head according to claim 1, wherein said at least one V-shaped cut is curved.

* * * * *